United States Patent [19]

Votava

[11] Patent Number: 4,630,461

[45] Date of Patent: Dec. 23, 1986

[54] TRANSFER FEED MECHANISM FOR POWER PRESSES

[75] Inventor: Ronald Votava, North Riverside, Ill.

[73] Assignee: Avondale Industries, Inc., New York, N.Y.

[21] Appl. No.: 735,437

[22] Filed: May 17, 1985

[51] Int. Cl.[4] ..... B21J 13/08

[52] U.S. Cl. ..... 72/405; 72/421; 198/621

[58] Field of Search ..... 72/405, 421; 198/621, 198/774

[56] References Cited

U.S. PATENT DOCUMENTS

| | | | |
|---|---|---|---|
| 1,477,778 | 12/1923 | Smith | 72/405 |
| 3,422,657 | 1/1969 | Grombka et al. | 72/405 |
| 4,038,862 | 8/1977 | Yamashita | 72/421 |
| 4,373,370 | 2/1983 | Allen et al. | 72/405 |
| 4,436,199 | 3/1984 | Baba et al. | 198/621 |

FOREIGN PATENT DOCUMENTS

| | | | |
|---|---|---|---|
| 117840 | 9/1981 | Japan | 72/422 |

OTHER PUBLICATIONS

*Machine Design,* "Mechanical Drives Reference Issue", vol. 48, No. 13, Jun. 3, 1976, pp. 19 and 20.

*Primary Examiner*—Daniel C. Crane
*Attorney, Agent, or Firm*—Leydig, Voit & Mayer

[57] ABSTRACT

A transfer feed mechanism, for use in a power press, is disclosed. The feed mechanism comprises multiple finger units for moving successive workpieces along a plurality of different axes so as to transfer the workpieces to desired work stations in desired positions and attitudes. The feed mechanism includes a power takeoff from the main drive of the power press, a plurality of drive means connected to the power takeoff for driving the finger units along the different axes in synchronism with the power press, and a secondary drive motor for driving the finger units along at least one of the axes independently of the power takeoff. The drive means includes at least one differential mechanism connected to both the power takeoff and the secondary drive motor to permit the finger units to be selectively driven by either the power takeoff or the secondary drive motor.

10 Claims, 9 Drawing Figures

TRANSFER FEED MECHANISM FOR POWER PRESSES

BACKGROUND OF THE INVENTION

This invention is directed to a novel transfer feed mechanism for power presses. More particularly, the present invention is preferably directed to an improved multi-axis transfer feed mechanism for use in a power press.

PRIOR ART

The many advantages of a transfer feed press as an economical, high production tool are well known. Suffice it to say that, compared to multi-press production lines, use of a transfer feed press usually results in high-speed production, more efficient use of floor space, lower manpower requirements, less maintenance of press and dies, and elimination of the need for many of the conveyor devices and storage areas usually associated with multi-press production lines.

Transfer feed motion of a workpiece through the press is often controlled by operating cam sets, a number of which may have cam surfaces which have been computer designed. Because workpiece-forming operations and the number of steps required to form a particular type of workpiece will vary from one type of workpiece to another, spatial adjustment of certain press parts, which co-act with specially designed workpiece-producing cams, generally must be made before each and every production run.

Accordingly, it can be appreciated that, in such presses, the die and/or cam sets are removable, and that different die and/or cam sets are later addable, for carrying out a variety of predetermined workpiece-forming steps.

It can still further be appreciated that die changeover, particularly because of the necessity of synchronizing longitudinal, transverse, and vertical movement of the workpiece (to satisfy feed press movement variables associated with the "new" die) and/or cam set, very often is a trial-and-error procedure, occasionally causing shutdowns which can result in substantial downtime and loss of operating efficiency.

Overloads, too, can occasionally result in substantial shutdown, because of the need to resynchronize and/or re-set commercially available press components, such as overload couplings, after the overload occurs.

OBJECTS AND SUMMARY OF THE INVENTION

It is, therefore, a general object of this invention to provide a transfer feed mechanism, for power presses, readily adjustable in the longitudinal, transverse and vertical directions after a cam set changeover or any other shutdown.

A more specific object is to provide a multi-axis adjustable transfer feed mechanism, for power presses, readily capable of being re-synchronized to a particular workpiece-forming step after occurrence of a shutdown.

Yet another object of the present invention is to provide a transfer feed mechanism, for power presses, which permits fine adjustment of feed mechanism component parts, acting along the longitudinal-stroke, transverse-stroke, or lift-stroke lines of action, without necessitating press shutdown.

A related object is to provide a transfer feed mechanism, for power presses, which achieves longitudinal, transverse and vertical movement of the workpiece through the press using a single power take-off source.

Yet another object is to provide a transfer feed mechanism, for power presses, which efficiently accomplishes synchronized longitudinal, transverse and vertical movement of the workpiece through the press, and which even permits varying the forward speed of the workpiece through the press (to the point of stopping) and reversing direction of workpiece travel through the press.

In accordance with the present invention, there is provided a transfer feed mechanism for use in a power press, the mechanism comprising the combination of multiple finger units for moving successive workpieces along a plurality of different axes so as to transfer the workpieces to desired work stations in desired positions and attitudes, a power takeoff from the main drive of the power press, a plurality of drive means connected to the power takeoff for driving the finger units along the different axes in synchronism with the press, and a secondary drive motor for driving the finger units along at least one of the axes independently of the power takeoff, the drive means including at least one differential mechanism connected to both the power takeoff and the secondary drive motor to permit the finger units to be selectively driven by either the power takeoff or the secondary drive motor. In the preferred embodiment, the finger units are mounted on at least one elongated rail so that the finger units can be moved along the different axes by moving the rail.

BRIEF DESCRIPTION OF THE DRAWINGS

The foregoing, as well as other objects, features and advantages of the present invention, will become more readily understood upon reading the following detailed description of the illustrated embodiments, together with reference to the drawings, wherein.

Throughout the drawings, like reference numerals refer to like parts.

DETAILED DESCRIPTION OF THE ILLUSTRATED PREFERRED EMBODIMENTS

While the invention will be described with reference to preferred embodiments, it will be understood that it is not intended to limit the invention to those embodiments. On the contrary, it is intended to cover all alternatives, modifications and equivalents as may be included within the spirit and scope of the invention as defined by the appended claims.

Figure 1:
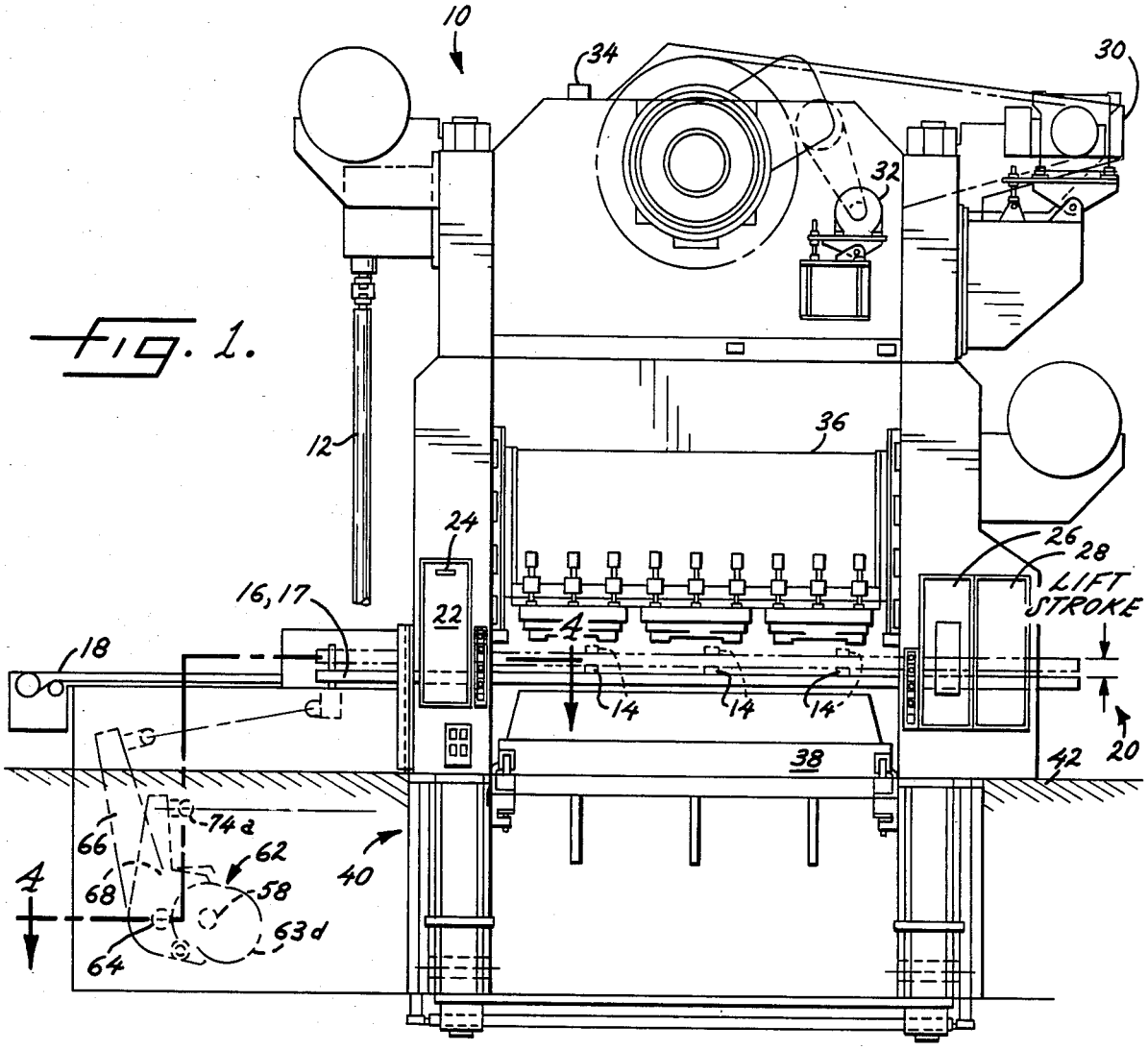
FIG. 1 is a side view of a power press, the view being transverse to the general line of travel of a forming workpiece as the workpiece is moved through the press, the press including the tri-axial feed mechanism of the present invention.
Figure 2:
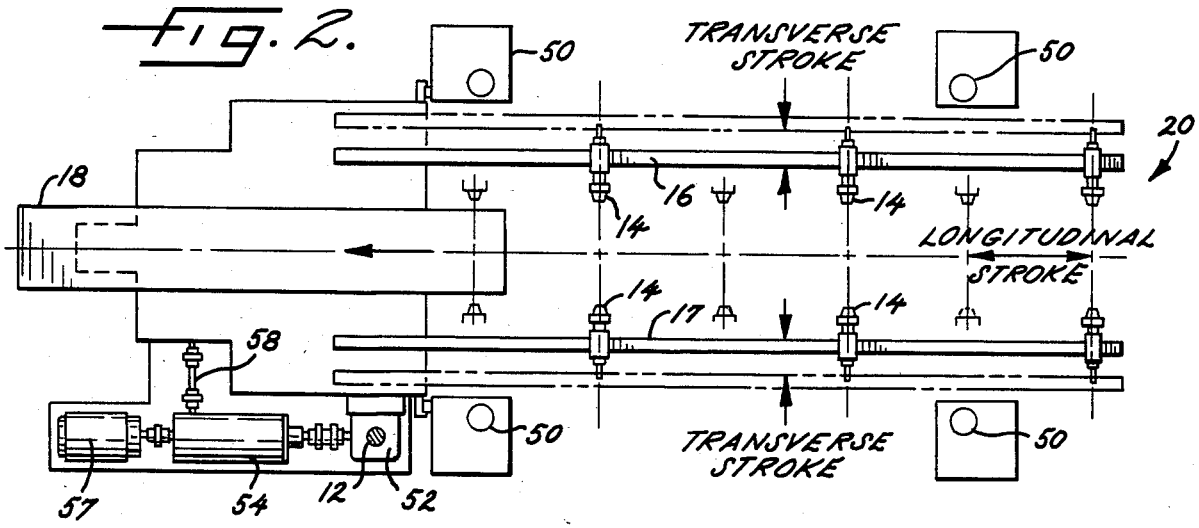
FIG. 2 is a top plan view, with much of the power press structure shown in FIG. 1 removed.

There is shown in FIG. 1 a power press 10 having a power take-off shaft 12. The power press 10 includes multiple finger units 14 for moving successive workpieces along a plurality of different axes so as to transfer the workpieces to desired work stations in desired positions and attitudes. Thus, the finger units 14 are movable along longitudinally disposed, longitudinally, vertically and transversely movable, elongated slide rails 16, 17 (FIG. 2). The longitudinal and transverse (FIG. 2) and lift movement (FIG. 1) of the rails 16, 17 causes the finger units 14 to move the workpiece through the press 10.

The finger units 14 are caused to engage a workpiece (not shown), and co-act with the workpiece-forming die (also not shown) of the power press 10, to form the workpiece into a desired shape. A conveyor 18 (FIGS. 1 and 2) is separately provided to remove the shaped workpieces from the power press 10. The finger units 14 co-act with each other, with the rails 16, 17, and with other press components to move workpieces through the power press 10, ejecting finished (or formed) workpieces at the discharge end 20 of the power press 10. The finished workpieces can then either be stacked at the discharge end 20 of the press 10, or transferred to a pick-up station (not shown), whichever is desired.

The illustrated power press 10 further includes an automatic die-change panel 22 (FIG. 1), a digital shut-height readout 24, a master operator station panel 26, an automation part-sensing panel 28, a press main motor 30, a so-called "inch" motor 32, a press control resolver 34, a slide-adjust motor 36, and a die carrier 38. The lowermost portion 40 of the power press 10 is supported beneath the floor line 42.

Figure 5:
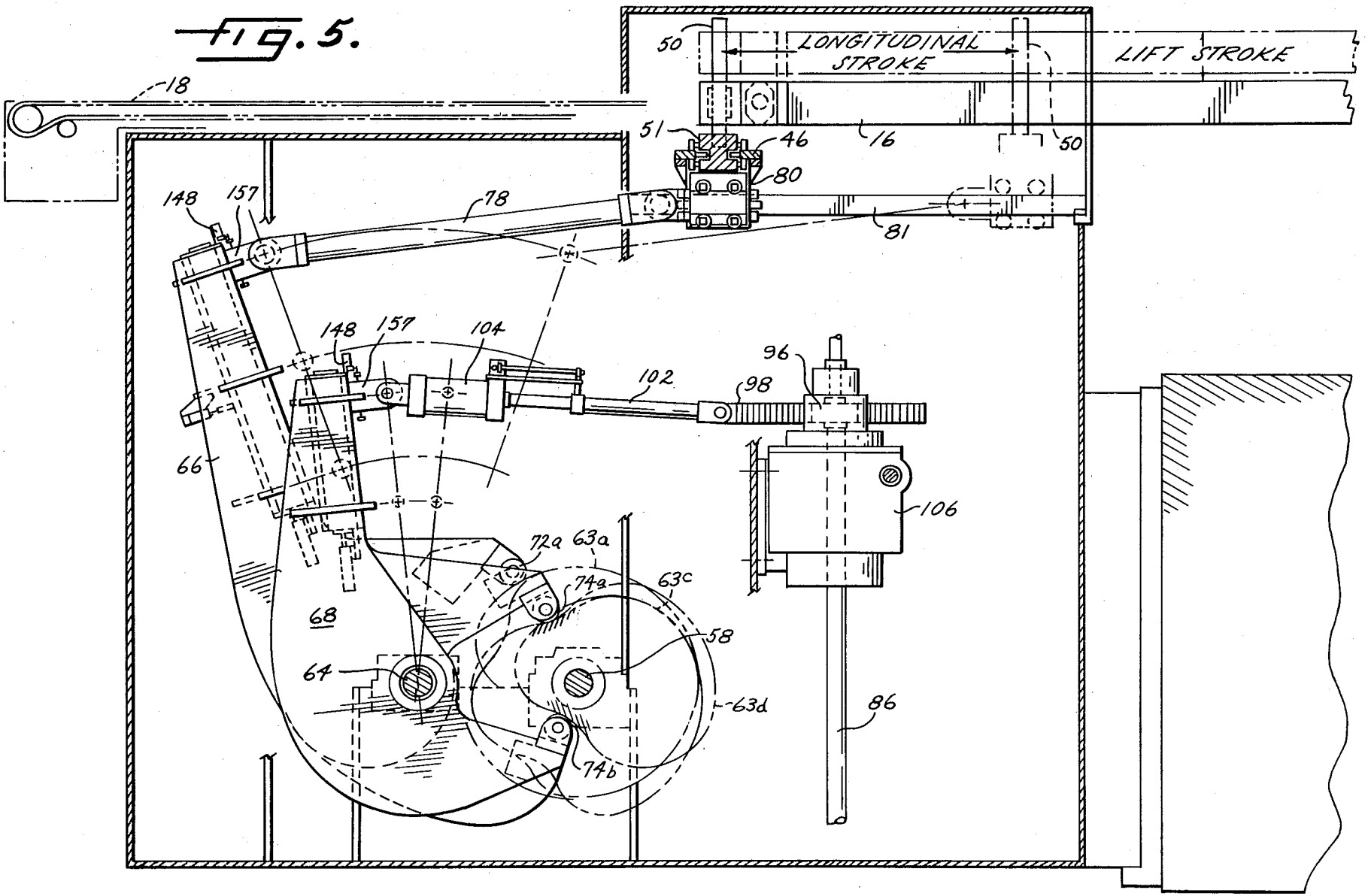
FIG. 5 is a partial, lateral-side view, taken along the lines 5—5 of FIG. 4.

The transfer feed mechanism 44 (refer to FIG. 3) includes the rails 16, 17, onto which the finger units 14 are mounted; spaced, transversely disposed guide rails 46 (FIG. 5) for guiding transverse motion of the slide rails 16, 17; two pairs of longitudinally spaced, transversely disposed, guide rails 48 atop which the rails 16, 17 are transversely movable (FIG. 3); and spaced pairs of vertically disposed guide rods 50 along which the rails 16, 17 are vertically movable (FIG. 5). The feed mechanism 44 further includes support structure 51 (FIGS. 3 and 5) for supporting the rods 50 in an upright manner. The power take-off shaft 12 is connected to the input side of a right-angle gear-speed reducer 52, the output side of which is coupled to a differential-gear mechanism 54 which drives a pinion gear 56. The differential-gear mechanism 54 can be driven either by the power take-off shaft 12, or by an auxiliary (or so-called "transfer-inch") motor 57, but not both.

The transfer-inch motor 57 is a separate, slow-speed, reversible, drive means which operates independently of the power take-off shaft 12. Normally, the transfer-inch motor 57 is disengaged from the differential-gear mechanism 54 and, accordingly, has no influence upon rotation of the pinion gear 56. Activation of the transfer-inch motor 57, however, causes the pinion gear 56 to be driven by the motor 57 rather than the power take-off shaft 12. Thus the transfer-inch motor 57 can be used to run the feed mechanism 44 through its entire cycle, as many times as necessary, for adjusting the finger units 14 in relation to various dies used in the press.

The differential mechanism 54 permits the feed mechanism to be set to any desired position via the motor 57 without de-coupling the feed mechanism from the power take-off from the press drive. This is particularly advantageous following a shutdown due to an overload condition, because there is no longer any need to manually reset the overload coupling to restore the desired synchronization between the press and the feed system. The manual resetting operation is often tedious and time consuming, and thus elimination of that operation increases the productivity of the press or press line. Moreover, the differential mechanism 54 also eliminates the need for clutches between the feed system and its two alternative drives, thereby simplify the feed system and reducing its cost.

Mounted on a cam shaft 58 is a bull (or main drive) gear 60, driven by the pinion gear 56, and a cam set 62. Individual cam surfaces **63*a* and 63*f* of the cam set 62 (FIG. 4) are specifically computer-designed to provide the transfer feed mechanism 44 with precise, predetermined longitudinal-stroke, transverse-stroke, and lift-stroke dimensions; and as briefly mentioned above, the illustrated cam set 62 is removable from the cam shaft 58, and another cam set (not shown) can be affixed to the cam shaft 58** for producing an entirely different type of workpiece.

Figures 3, 9:
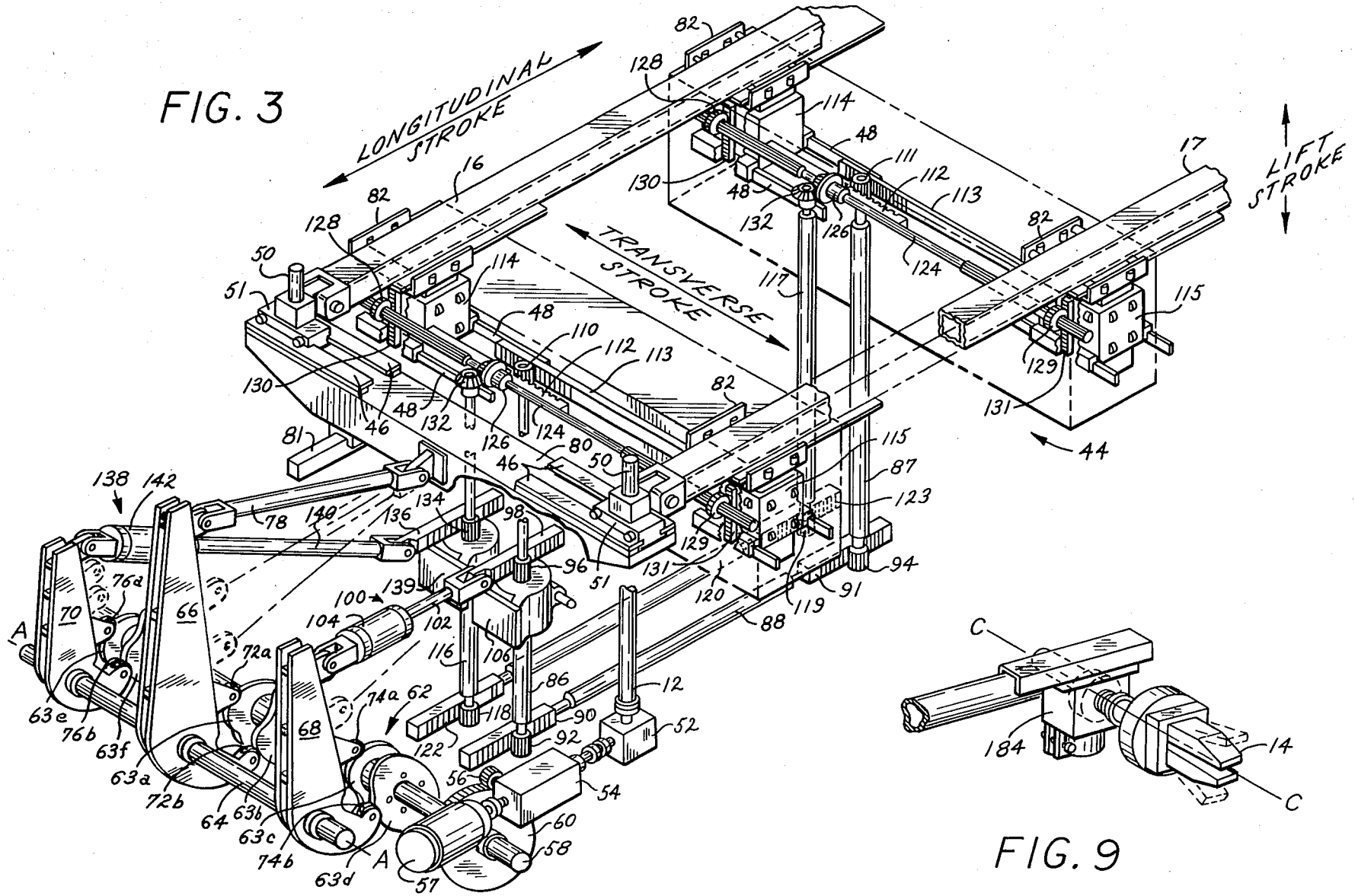
FIG. 3 is a partially fragmented, isometric view of the tri-axial transfer feed mechanism of the present invention, the scale of FIG. 3 being enlarged relative to FIGS. 1 and 2.
FIG. 9 is a fragmented, isometric view of an optional finger unit, usable in combination with the transfer feed mechanism of the present invention (but not otherwise shown in FIGS. 1-8).
Figure 4:
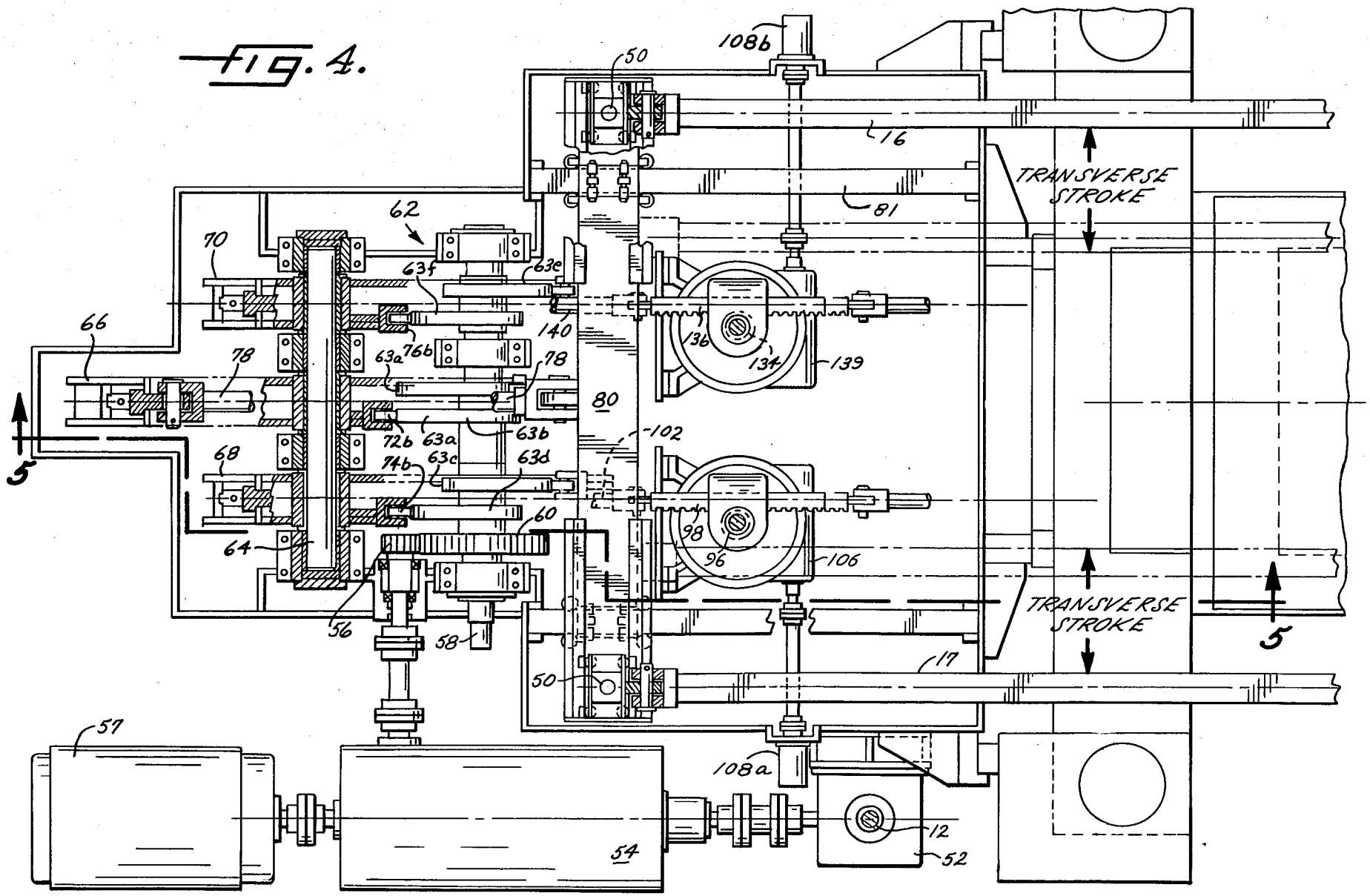
FIG. 4 is a partially fragmented, upper, sectional view, taken along the lines 4—4 of FIG. 1, on an enlarged scale relative to FIGS. 1-3.

Longitudinally spaced from the cam shaft 58 is a fixed, transversely disposed rocker-arm shaft 64 (FIGS. 3 and 4) onto which are mounted three rocker arms 66, 68 and 70. The first, second and third rocker arms 66, 68 and 70 are each independently pivotable about the axis A—A (FIG. 3) of the rocker arm shaft 64. The first rocker arm 66 controls the longitudinal stroke; the second rocker arm 68 controls the transverse stroke; and the third rocker arm 70 controls the lift or vertical stroke of the slide rails 16, 17. Each of the rocker arms 66, 68 and 70 has a pair of respective cam followers **72*a*, 72*b*, 74*a*, 74*b*, 76*a*, and 76*b* which ride on a respective one of the conjugate cam surfaces 63*a*–63*f* of the cam set 62 (FIG. 4). Each of these cam surfaces 63*a*–63*f*** controls movement of the feed mechanism in one direction along one of the three axes, thereby insuring a positive drive in both directions along each of the three axes.

To provide the longitudinal stroke, an elongated connecting member 78 (FIGS. 3–5) couples the first rocker arm 66 to a transversely disposed support member 80 which, in turn, carries the rails 16, 17 (FIG. 5). Pivoting motion of the rocker arm 66 causes the support member 80 to slide along structure 81 (FIGS. 3 and 5) thereby effecting the longitudinal stroke for the rails 16 and 17. The motion of the arm 66 also causes the rails 16, 17 to be longitudinally moved relative to U-shaped support structures 82 (FIG. 3).

To provide the transverse (or finger drive) stroke, a pair of vertically disposed, longitudinally spaced, rotatable shafts 86, 87 (FIG. 3) are controlled by operation of the second rocker arm 68. This is accomplished through an elongated connecting member 88 having rack gears 90, 91 at each end thereof. The first and second vertically disposed shafts 86, 87 each has a respective pinion gear 92, 94 mounted on the lower end portion thereof; and both of the pinion gears 92, 94 mesh with the respective first and second rack gears 90, 91 (of the connecting member 88) for synchronizing rotation of the first and second shafts 86, 87.

Also mounted on the first shaft 86 is a shaft drive pinion gear 96 which, in turn, is driven by a rack gear 98 coupled to the second rocker arm 68. A clamp-channel slide-overload connecting link 100 couples the second rocker arm 68 to the rack gear 98. The clamp-channel slide-overload link 100 comprises an elongated connecting member 102 coupled to the rack gear 98, and a hydraulic cylinder 104 coupled to the second rocker arm 68 and the elongated member 102 (FIGS. 3 and 5).

In addition to being controlled by the second rocker arm 68, the synchronized rotation of the first and second shafts 86, 87 is, in accordance with one of the above-mentioned features of the present invention, independently controllable by a first differential-gear mechanism 106 which, in turn, is driven by a D.C. motor 108*a* (FIG. 4). This differential-gear mechanism 106, which can be driven simultaneously by the rocker arm 68 and the motor 108 if desired, has the effect of adjusting the end point of the transverse stroke. Thus, the end point of the transverse stroke can be adjusted for different dies by merely energizing the motor 108*a*, without affecting the other axes. Similarly, a workpiece can be unclamped in the middle of a cycle (in the event of a malfunction such as a mis-aligned workpiece, for example) by simply energizing the motor 108*a*, rather than running the feed mechanism all the way to the end of its cycle.

To prevent the differential from drifting when the motor 108*a* is not energized, a brake is preferably provided on the output shaft of the motor 108*a* for activation whenever this motor is deenergized.

Mounted on the uppermost end of each respective one of the first and second shafts 86, 87 is a respective pinion gear 110, 111 (FIG. 3). First and second rack gear-set elements 112, 113 are respectively coupled to support structure 114, 115 which carries the earlier-mentioned support structure 82 (FIG. 3). The first and second rack gear-set elements 112, 113 meshably engage with opposite sides of the first pinion gear 110 (and a like set of elements 112, 113 similarly engages with the second pinion gear 111), whereby rotation of the first shaft 86 causes the first and second support structures 114, 115 to be spaced apart or drawn together thereby effecting the transverse stroke of the slide rails 16, 17 along the guide rails 48 (FIG. 3).

It can further be appreciated that, during the course of the transverse stroke, it is the pivoting action of the second rocker arm 68 which causes support structure 51 (FIG. 5), which carries the rails 16, 17, to slide along the guide rails 46 (FIG. 5) which carry the support member 80, thereby effecting the above-discussed transverse stroke (FIG. 4).

To provide the feed mechanism 44 with the lift or vertical stroke discussed above, a pair of vertically disposed, longitudinally spaced, rotatable shafts 116, 117 are arranged in a manner so as to be rotated in synchronization through operation of the third rocker arm 70. Mounted at the lower end of each one of the first and second shafts 116, 117 is a respective pinion gear 118, 119. An elongated connecting member 120 having rack gears 122, 123 at respective end portions thereof (which rack gears 122, 123 respectively mesh with the first and second pinion gears 118, 119) synchronously couples rotation of the second shaft 117 to rotation of the first shaft 116.

Further, each one of a pair of transversely disposed, longitudinally spaced, rotatable shafts 124 has mounted thereon an intermediately mounted bevel gear 126, and a pair of spaced pinion gears 128, 129 mounted on opposite end portions thereof.

Each of the first and second support structures 114, 115 has mounted thereon a respective rack gear 130, 131, which meshably engages a respective one of the first and second pinion gears 128, 129 (FIG. 3). Mounted atop each one of the first and second shafts 116, 117 is a second bevel gear 132, which meshably engages the first bevel gear 126, to cause the shafts 124 to rotate in synchronization when the shaft 116 is caused to rotate.

Rotation of the shafts 124 causes the support structure 114, 115 (which, in turn, carries the slide rails 16, 17) to move vertically up or down relative to the guide rods 50, thus effecting the above-mentioned lift stroke (FIGS. 3 and 5).

The vertically disposed shaft 116 further includes an intermediately mounted pinion gear 134 driven by a rack gear 136 which, in turn, is coupled by a lift-channel slide-overload connecting link 138 (FIG. 3) to the third rocker arm 70.

In addition to being controlled by the third rocker arm 70, the synchronized rotation of the first and second vertically disposed shafts 116 and 117 is, also in accordance with the above-mentioned features of the present invention, independently controlled by a second differential-gear mechanism 139 which, in turn, is driven by a second D.C. motor 108*b* (FIG. 4) equipped with a brake on its output shaft. This differential mechanism 139 provides the same advantages described above in connection with the differential mechanism 106. The ability to adjust the end point of the stroke via the motor 108*b* is particularly important for the vertical axis because the transfer mechanism should always the returned to the same vertical position at the end of a cycle, regardless of the length of the stroke.

It will be appreciated that the three differential mechanisms permit independent adjustment of the feed mechanism along each of its three axes of movement. That is, the transverse and vertical positions can be independently adjusted via the differentials 106 and 139, respectively, with the longitudinal position being adjusted via the differential 54. If desired, a third single-axis differential, similar to the differentials 106 and 139, can be added for the longitudinal axis.

The lift-channel slide-overload link 138 comprises an elongated connecting member 140 coupled to the rack gear 136, and a second hydraulic cylinder 142 coupled to the elongated connecting member 140 and the third rocker arm 70 (FIG. 3). The cylinders 104 and 142 function as overload-prevention and "safety" (or dampening) devices.

As another feature of the invention, the means connecting the rocker arms to said finger units includes an adjustment mechanism for adjusting the point of connection to each rocker arm and thereby adjusting the length of the stroke of said finger units effected by movement of the rocker arm.

Typical maximum stroke lengths for movement of the finger units 14 are 60 inches for the longitudinal stroke, 16 inches for the transverse stroke, and 10 inches for the lift stroke, although these stroke dimensions can be varied from these maximum values. Because variable connections can be made from each one of the first, second and third rocker arms 66, 68 and 70 to the respective connecting members or links 78 or 100 and 138, these maximum stroke dimensions are easily variable. For example, the longitudinal stroke is preferably variable from 60 inches to 45 inches (or even to 30 inches) by adjustment of the pivot point at which the connecting member 78 is coupled to the rocker arm 66 (relative to the rocker-arm shaft 64). (See FIGS. 3, 6 and 8.) The pivot point for each of the second and third rocker arms 68 and 70 is similarly adjustable.

Figure 6:
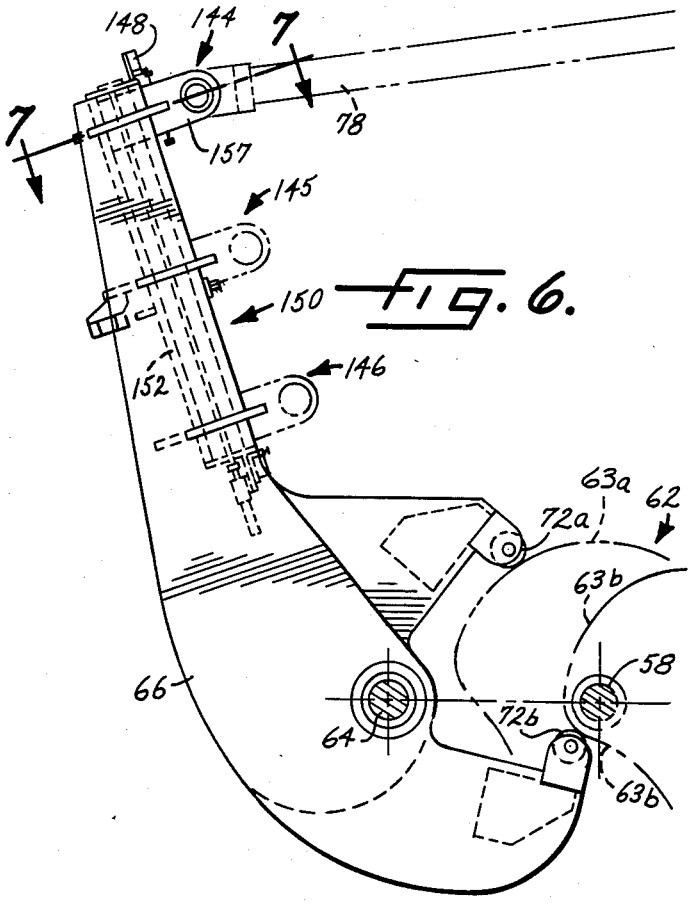
FIG. 6 is a detailed view of one of the rocker arms shown in FIG. 5.

Referring to FIG. 6, it can be seen that the first rocker arm 66 has three positions 144, 145 and 146 at which the elongated member 78 can be connected to the rocker arm 66 at successively decreasing radial dimensions (relative to the rocker-arm shaft 64) for reducing the longitudinal stroke. The first position 144 provides the 60-inch stroke, the second position 145 provides the 45-inch stroke, and the third position 146 provides the 30-inch stroke, mentioned above in connection with longitudinal movement.

Figure 7:
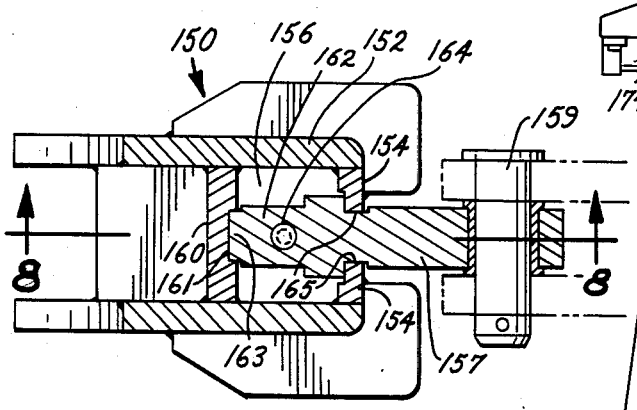
FIG. 7 is a fragmented, sectional view, taken along the lines 7—7 of FIG. 6, on an enlarged scale relative to FIG. 6.
Figure 8:
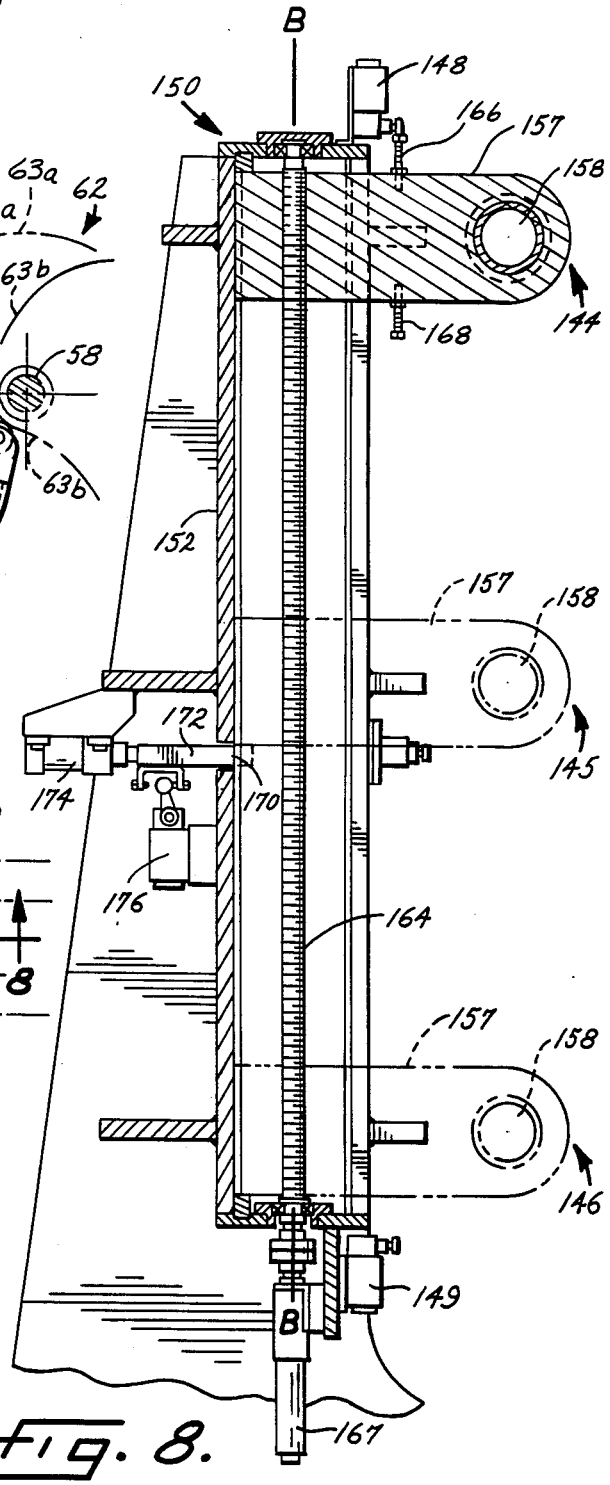
FIG. 8 is a longitudinal, sectional view, taken along the lines 8—8 of FIG. 7.

Although the preferred embodiment illustrated in FIGS. 6–8 discloses means for varying the radial spacing of the connecting member 78 relative to the rocker-arm shaft 64 at discrete positions 144, 145 and 146, it can be appreciated that other applications of the present invention may require continuous variability of the connecting member 78 between two radially-spaced points (relative to the rocker-arm shaft 64). For example, a rack and pinion gear set could be used to effect such continuous variability.

To effect the discretely spaced variability shown in FIG. 6, there is preferably mounted on each rocker arm (FIG. 8) a pair of radially spaced sensing elements 148, 149, which signal when a connection is made at either the upper (or first) position 144, or at the lower (or third) position 146 (FIGS. 6 and 8). A position-variation assembly 150, carried by each one of the rocker arms 66, 68 and 70, comprises a hollow, elongated member 152 having a pair of spaced jaws 154 leading into an elongated opening 156 in the member 152 (FIG. 7), and a slidable pivot 157 having an eye 158. The pivot 157 is slidably engageable with the elongated member 152. A pivot pin 159 (FIG. 7), through the eye 158, secures the connecting member 78 to the rocker arm 66. The slidable pivot 157 is caused to slide along the jaws 154 of the elongated member 152.

A plate 160, having an elongated slot (or groove) 161, is spaced from the jaws 154 and defines the end of the opening 156. An end portion 162 (of the slidable pivot 157), distally spaced from the eye 158, is insertable into the opening 156. The slidable pivot end portion 162 has an elongated boss 163 (FIG. 7) which is longitudinally slidably engageable within the elongated slot 161. To further stabilize the slidable pivot 157, as it is caused to move along the jaws 154, a pair of spaced grooves or slots 165, against which the respective jaws 154 are slidably engageable, are formed in the slidable pivot 157 (FIG. 7).

An elongated threaded member 164 is longitudinally disposed within the opening 156 (FIG. 8) for sliding the pivot 157 along the jaws 154. The threaded member 164, rotatably carried by the elongated member 152, itself threadedly carries the slidable pivot 157 and is rotatable relative thereto. Rotation of the threaded member 164 about an axis B—B (FIG. 8), as caused by an air motor 167 (FIG. 8), in turn causes the slidable pivot 157 to move up or down along the length of the jaws 154, depending upon rotation of the threaded member 164.

Although the air motor 167 is the preferred device for causing rotation of the threaded member 164 about the axis B—B, it can be appreciated that a commercially available servomotor would serve the same function (as an air motor).

The slidable pivot 157 carries upper and lower push pins 166, 168 (FIG. 8) for activating the respective upper and lower sensing elements 148, 149, as above mentioned.

Formed in the hollow member 152, preferably between the upper and lower sensing elements 148 and 149, is a slot 170 into which a plate 172 is slidable by a device 174 (e.g. an air-actuated device, hydraulic cylinder or servomechanism) for positively locating the slidable pivot 157 at the second or intermediate position 145 of the hollow member 152 (FIG. 8). Movement of the plate 172 (by the device 174) activates a sensing device 176 which signals when the intermediate position 145 of the pivot 157 (relative to the hollow member 152) is achieved.

It can further be appreciated that each of the finger units 14 could also include its own motion means 184 for opening and closing the finger portions of the finger units 14 and for rotating a finger unit 14 about an axis C—C, thereby providing each finger unit 14 with a fourth degree of motion, as is shown in FIG. 9.

What has been illustrated and described herein is a novel transfer feed mechanism for power presses. While the transfer feed mechanism of the present invention has been illustrated and described with reference to preferred embodiments, the present invention is not limited thereto. On the contrary, alternatives, changes or modifications may become apparent to those skilled in the art upon reading the foregoing description. Accordingly, such alternatives, changes and modifications are to be considered as forming a part of the invention insofar as they fall within the spirit and scope of the appended claims.

I claim:

1. A power press with a transfer feed mechanism comprising the combination of:

multiple finger units for moving successive workpieces along a plurality of mutually perpendicular axes so as to transfer the workpieces to desired work stations in desired positions and attitudes, a main drive connected to said power press for driving said press, a power takeoff from the main drive of said power press, a plurality of drive means connected to said power takeoff through at least one differential mechanism for independently driving said finger units along said mutually perpendicular axes in synchronism with said power press, and a secondary drive motor connected to said drive mechanism for driving said finger units along at least one of said axes independently of said power takeoff, whereby said differential mechanism connected to both said power takeoff and said secondary drive motor permits said finger units to be selectively driven by either said power takeoff or said secondary drive motor in order to adjust said transfer feed mechanism along said mutually perpendicular axes.

2. A power press with a transfer feed mechanism as set forth in claim 1 wherein said finger units are mounted on at least one elongated rail whereby the finger units can be moved along said different axes by moving said rail.

3. A power press with a transfer feed mechanism as set forth in claim 1 which includes a plurality of said secondary drive motors for driving said finger units along different ones of said axes, and a plurality of said differential mechanisms each of which connects one of said secondary drive motors to said finger units.

4. A power press with a transfer feed mechanism as set forth in claim 1 wherein said plurality of drive means include cams for controlling the movement of said finger units along the respective axes.

5. A power press with a transfer feed mechanism as set forth in claim 1 which includes at least one differential mechanism and secondary drive motor for driving said finger units simultaneously along said plurality of different axes.

6. A power press with a transfer feed mechanism as set forth in claim 1 which includes a first differential mechanism and secondary drive motor for driving said finger units simultaneously along said plurality of different axes, and at least one second differential mechanism and secondary drive motor for driving said finger units along a selected one of said axes.

7. A power press with a transfer feed mechanism including means for moving a workpiece along first, second and third mutually perpendicular paths of travel, said transfer feed mechanism comprising:

a cam and rocker-arm mechanism carried by the press for independently effecting movement of each one of the workpiece first, second and third path-travel means along the respective path associated therewith in a preselected synchronized manner;

means carried by the press for driving said cam and rocker-arm mechanism;

seconardary drive means mounted in said press; and at least two differential-gear mechanisms independently-operable by said secondary drive means, each of said mechanisms coupled between said drive cam and rocker-arm mechanism and one of the first, second and third path-travel means, for independently varying the synchronized movement of two of the first, second and third path-travel means relative to any other one of the first, second and third path-travel means.

8. A power press with a transfer feed mechanism as set forth in claim 7 further including a third independently-operably differential-gear mechanism for controlling the synchronized motion of all of the first, second and third path-travel means along the respective paths associated therewith.

9. A power press with a transfer feed mechanism including means carried by the press for moving a workpiece along a path, means carried by the press for moving said workpiece along a first direction transverse to said path, and means carried by the press for moving said workpiece along a second direction transverse to said path, said second direction being transverse to said first direction, said feed mechanism comprising:

first, second and third rocker-arms carried by the press and pivotable about a common axis;

means carried by the press for coupling each of the three rocker-arms to a respective one of the three workpiece-moving means;

each of the rocker-arms including corresponding means carried thereby for adjusting spacing of the respective coupling means associated therewith relative to the rocker-arm axis for independently varying movement of the workpiece along the path and each of the first and second directions;

cam means carried by the press for independently effecting movement of each one of the three rocker-arms for causing variable movement of the workpiece along the path and each of the first and second directions;

means carried by the press for driving the cam means;

secondary drive means mounted in said press; and at least two differential-gear mechanisms independently-operable by said secondary drive means coupled between two of the three rocker-arms and a corresponding two of the workpiece-moving means, for synchronizing movement of any one workpiece-moving means relative to any one of the other two workpiece-moving means.

10. The power press of claim 9 wherein the transfer feed mechanism further includes a third independently-operable differential-gear mechanism for controlling the motion of all of the first, second and third path-travel means along the respective path associated therewith.

* * * * *